US006244999B1

(12) United States Patent
Alessandri

(10) Patent No.: US 6,244,999 B1
(45) Date of Patent: Jun. 12, 2001

(54) MACHINE FOR EXERCISING MUSCLES

(75) Inventor: Nerio Alessandri, Longiano (IT)

(73) Assignee: Technogym S.r.L., Gambettola (IT)

( * ) Notice: Subject to any disclaimer, the term of this patent is extended or adjusted under 35 U.S.C. 154(b) by 0 days.

(21) Appl. No.: 09/271,162

(22) Filed: Mar. 17, 1999

(30) Foreign Application Priority Data

Mar. 17, 1998 (IT) ..... BO98A0170

(51) Int. Cl.[7] ..... A63B 23/00
(52) U.S. Cl. ..... 482/142; 482/137; 482/108
(58) Field of Search ..... 482/482, 106, 482/107, 108, 139, 137, 92, 93, 99, 101–103

(56) References Cited

U.S. PATENT DOCUMENTS 1,333,005 * 3/1920 Warner ..... 482/106
3,384,370 * 5/1968 Bailey et al. ..... 482/106
4,461,473 * 7/1984 Cole ..... 482/108
4,629,184 * 12/1986 Selkee ..... 482/106
4,690,400 * 9/1987 Metz ..... 482/106
4,743,018 * 5/1988 Eckler ..... 482/106
5,334,113 * 8/1994 Roepke ..... 482/106
5,718,654 * 2/1998 Kennedy ..... 482/139
5,730,689 * 3/1998 Haugen ..... 482/139
6,022,299 * 2/2000 Stewart ..... 482/102

* cited by examiner

*Primary Examiner*—Jerome Donnelly
(74) *Attorney, Agent, or Firm*—Pillsbury Winthrop LLP

(57) ABSTRACT

Machine for exercising muscles wherein at least one lever able to be actuated in rotation to exercise upper body muscles terminates with an elongated portion presenting a first longitudinal axis oriented in a determined direction; a handle being supported by the lever in end position by means of a respective sleeve; a first body substantially cylindrical and able to gripped by a user being hinged to the sleeve in correspondence with a second axis substantially transverse to the first axis, the first body being mounted on the sleeve in a manner allowing it to rotate around a determined axis; an adjustment set being provided to adapt the trajectory of the first body to the anthropometric measurements of the users.

19 Claims, 4 Drawing Sheets

4 a 4 b

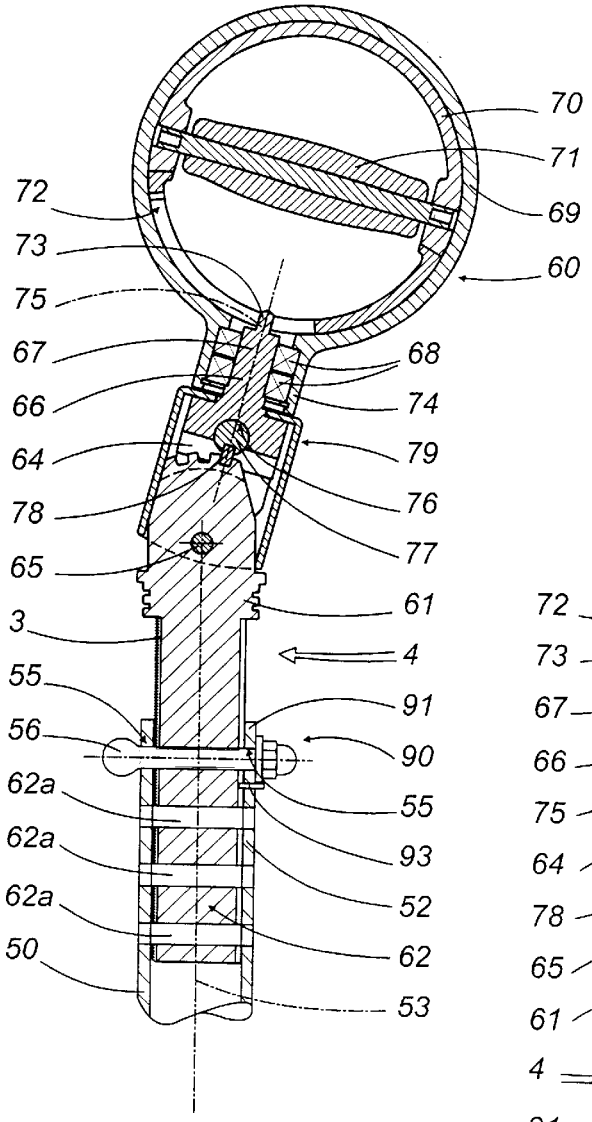
FIG. 5
FIG. 6
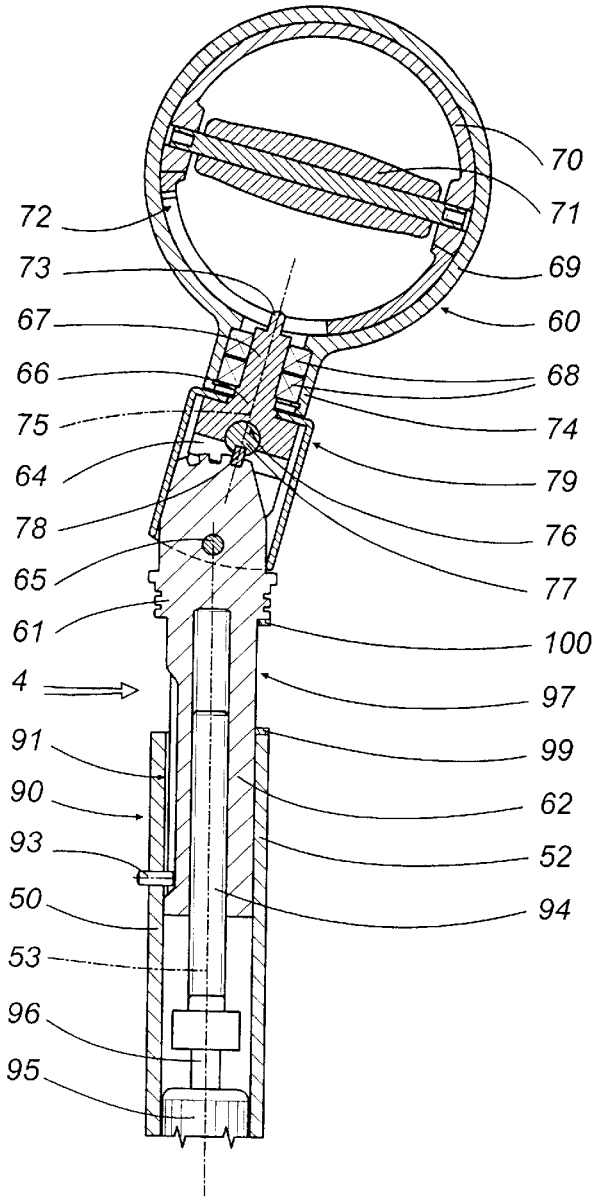

MACHINE FOR EXERCISING MUSCLES

BACKGROUND OF THE INVENTION

The present invention relates to a machine for exercising muscles, effectively employable to train muscles of the upper part of the body, shoulders, back, chest, which for the sake of brevity, shall hereafter be indicated as "upper body muscles".

Normally, exercise machines for training upper body muscles are provided with a frame supporting a load unit, with counterweight or electrical, with which a user exchanges power by means of at least one lever with its fulcrum in the frame itself. Such a lever, normally realized with a tubular body, is gripped in its end position, in such a way as to maximize the physical lever arm, and hence power exchanges with the load unit. To render the gripping of the lever in the end position more comfortable, the lever is usually coated with a sleeve closed at one end, in such a way as to seal the lever itself. Such a sleeve is made of material presenting high friction coefficient in contact with the user's hands, in order to favor a secure grip on the lever, and prevent involuntary releases of the load, which in counterweight machines could be dangerous.

Normally, the end portion of the lever is oriented according to a determined position, in relation to the trajectory that needs to be effected to train a given muscle district. On the other hand, in order to allow users presenting different anthropometric measurements to assume the postures required for the execution of determined exercises, the sleeve presents a greater extension than the average palm of the human hand, so that even users with particularly long or short arms can safely activate the lever regardless of the point whereat they grip the sleeve.

Naturally, the gripping position will influence the angles scanned by the user's limbs, and the trajectories of the various junctions will be affected by this parameter. Therefore, on the same machine, different users will train muscle districts that are only approximately identical. In fact, the opportunity to train the target muscle district is reserved to a user whose anthropometric measurements are those adopted for the dimensioning of the machine.

Some designers have sought to reach trajectory uniformity and improve the ergonomics of the machines in question by adopting levers ending with annular handles, wherein the sleeve is mounted on a ring connected to the end of the lever so that it is able to rotate on an angle of determined amplitude. It should be noted that this does not solve the problem identified above, but only frees the user's wrist to assume the most conservative angle of the wrist and elbow joints.

SUMMARY OF THE INVENTION

The aim of the present invention is to realize a machine for exercising muscles that if free of the drawbacks described above.

A further aim of the present invention is to realize levers provided with handles adjustable in such a way as to allow users presenting different physical conformations to train on the same machine on personalized trajectories. This, naturally, presents evident economic advantages, as it allows designers to define the machines with reference to standardized anthropometric types, and provides the users with the opportunity to adapt the machine to their own anthropometric measurements, even when the machines are destined to public use, as in gymnasiums.

According to the present invention a machine for exercising muscles is realized; said machine being provided with at least one lever which can be actuated around a fulcrum axis to exercise the upper body muscles; each said lever terminating with an end portion presenting a first longitudinal axis oriented in a determined direction; said end portion supporting a handle for actuating said lever; said handle further presenting a first substantially cylindrical body which can be gripped by a user and a substantially prismatic sleeve housed inside said end portion; characterized in that said first body is hinged to said sleeve around a second axis substantially transverse to said first axis; an adjustment set being provided for each said lever to vary the position of said first body with respect to an origin of said lever, to adapt the trajectory of said first body to the users' anthropometric measurements.

BRIEF DESCRIPTION OF THE DRAWINGS

The invention shall now be described with reference to the accompanying drawings, which show a non limiting embodiment, in which:

FIG. 5 is an enlarged scale section with parts removed for the sake of clarity of a second variation of the detail of FIG. 3, performed according to a longitudinal plane; and FIG. 6 is an enlarged scale section with some parts removed for the sake of clarity of a third variation of the detail of FIG. 2, performed according to a longitudinal plane.

DESCRIPTION OF THE PREFERRED EMBODIMENTS

Figure 1:
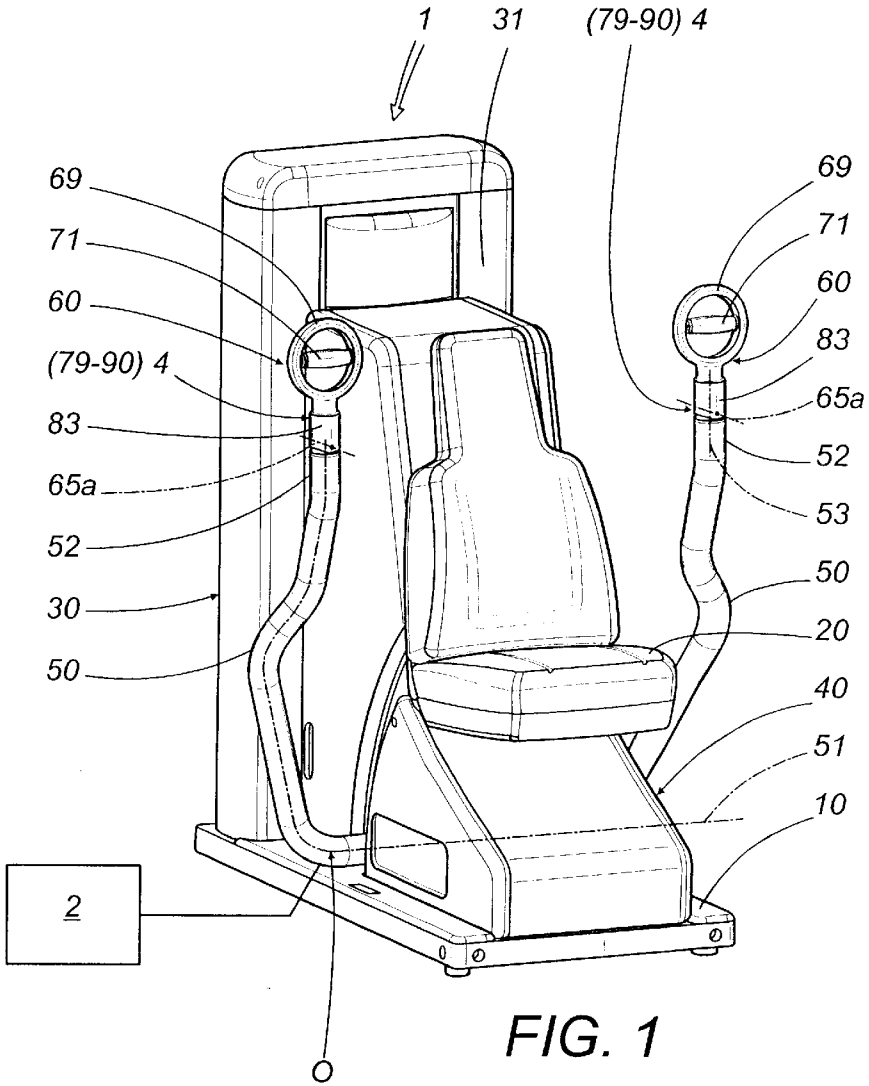
FIG. 1 is a schematic perspective view of a preferred embodiment of a machine according to the present invention.

In FIG. 1, the number 1 indicates, in its entirety, a machine for exercising muscles of the type normally known by the name "chest press". In particular, the machine 1 is effectively usable to train chest muscles, brachial triceps and deltoids, without thereby detracting from the general nature of the description that follows.

With reference to FIG. 1, the machine comprises a frame 10, a seat 20 supported by the frame 10 and able to support a training user, a load unit 30, and an articulated device 40, whereof only a pair of levers 50 is visible. Such levers 50 can be actuated in rotation by a user to exchange power with the unit 30 around a respective origin 0 visible only in FIG. 1. Arbitrarily, but in a unequivocally clear manner, it is decided to define this origin as the intersection between the normally curvilinear longitudinal axis of the lever 50 and the fulcrum axis 51 of the lever 50 itself, such axis 51 being substantially horizontal and positioned below the seat 20 (FIG. 1).

The load unit 30, which is purposely shown in an approximated manner in FIG. 1, is of the mechanical type, and comprises a column organ 31 (visible only in FIG. 1) containing a plurality of plates, known and not shown. Such known and not shown plates are vertically movable inside the column organ 31, as in all so-called "isotonic machines". The user's training is obtained as a result of the actuation of the levers 50, and hence as a result of the alternating lifting and lowering of the known and not shown plates inside the column organ 31. At the end of each lever 50 is positioned a handle 60, employable by a user to actuate the lever 50 in rotation.

Figure 2:
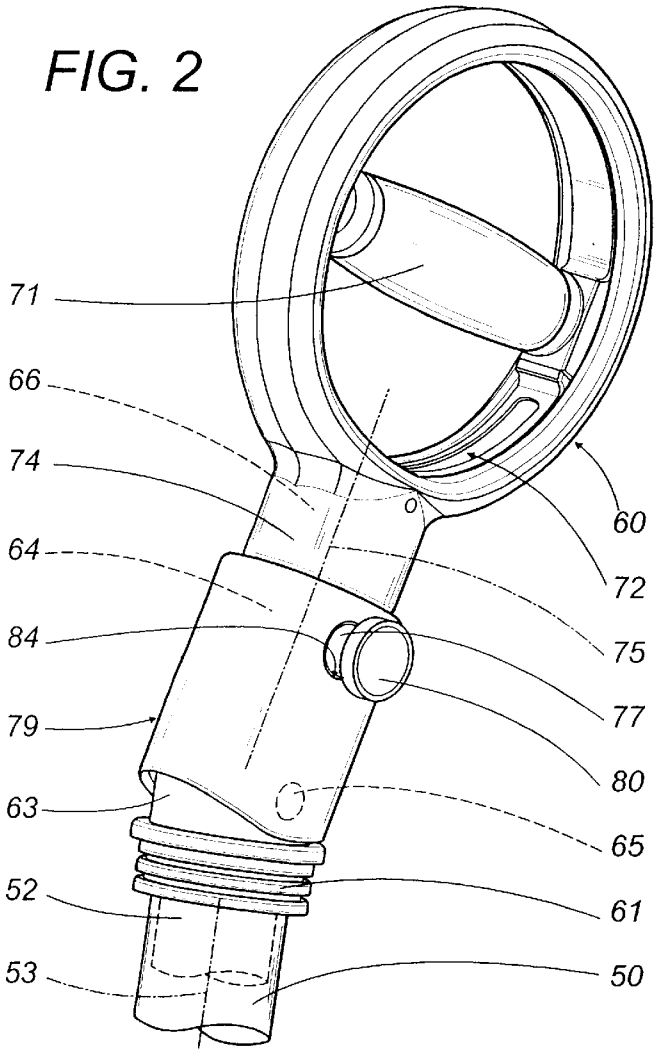
FIG. 2 is a schematic perspective view in enlarged scale and with parts removed for the sake of clarity of a first version of a detail excerpted from FIG. 1.
Figure 3:
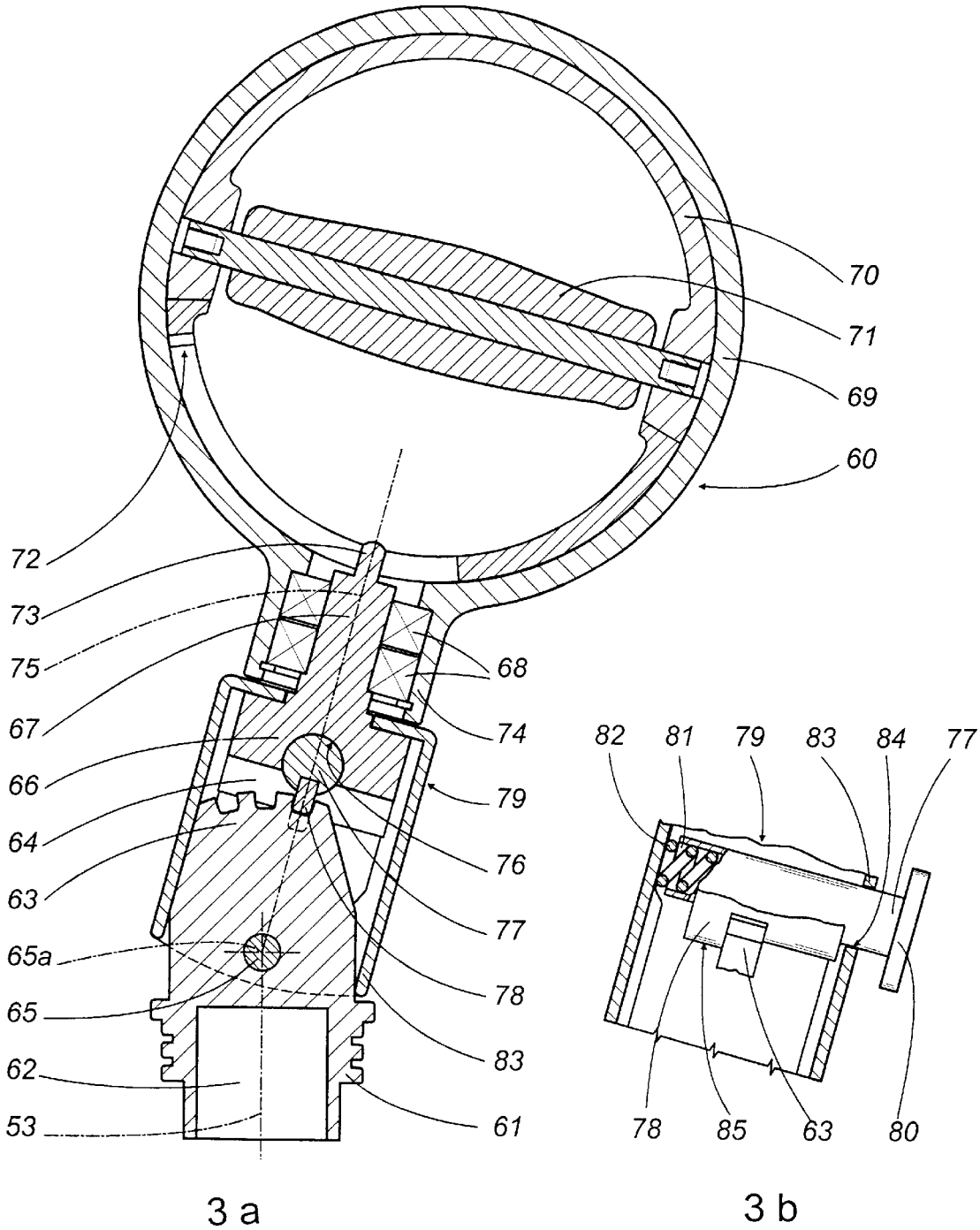
FIG. 3 is an enlarged scale section with parts removed for the sake of clarity of the detail of FIG. 2 performed according to a longitudinal plane.

With reference to FIGS. 2 and 3, the handle 60 presents a sleeve 61 partially housed inside an end portion 52 of the lever 50 with a respective tubular body 62 shaped prismatically and, in particular, in a manner mated to the surface that internally delimits the portion 52. This portion 52 presents prismatic shape, and in particular cylindrical in FIGS. 1 and 2, and presents a longitudinal axis 53, whereto the sleeve 61 is substantially coaxial. The sleeve 61 terminates, at the side opposite to the tubular body 62, with a toothed sector 63. The sleeve 61 supports a fork 64 in an articulated manner, through the interposition of a pin 65 orthogonal to the axis 53. This pin engages at the root the toothed sector 63, and the two wings of the fork 64, whereof only one is partially visible with reference to FIG. 3. The fork 64 presents, at the side opposite to the pin 65, a substantially cylindrical spigot 66 provided with a cylindrical end portion 67 that rigidly supports, by interference, a pair of radial rolling bearings 68, in such a way as to be free to swivel transversely to the axis 65*a*.

The handle 60 further comprises a protecting organ provided with a pair of annular bodies 69 and 70, wherein the second one is contained inside the first. The handle 60 further comprises a grip 71 supported by the annular body 70 in correspondence with a respective diameter. It should be noted that the annular body 69 supports the annular body 70 in a freely rotating manner, and the latter presents a peripheral slot 72 with an amplitude approximately 90° engaged by a cylindrical projection 73 of the portion 67. The grip 71 in turn is free to rotate around its own longitudinal axis, integral with the annular body 70. This projection 73 serves, in use, as a stop, being able to limit the angle of rotation of the annular body to the amplitude of the slot 72. The annular body 69 presents, on the side of the lever 50, an internally hollow spigot 74, which internally houses the two radial bearings 68, whereby it is supported in a rotatory manner around a central axis 75 of the projection 73. Said axis 75 tranverses the longitudinal axis 65*a* of the pin 65.

The fork 64 presents a cylindrical seat 76 parallel to the axis 65*a* for an organ for block the rotation of the fork 64 around the axis 65*a* itself. Such blocking organ is obtained by means of a pin 77 provided with a longitudinal blocking organ able selectively to engage at lease one compartment of said sector 63. Such blocking organ is, in particular, a tab 78, which selectively engages at least one of the compartments of the sector 63.

The pin 77 presents at its top a portion 80 with enlarged diameter, and at the bottom a longitudinal seat housing a spring 82. The handle 60 further comprises a cup shaped body 83 fitted onto the fork 64, and maintained fixed by the spigot 74, to hold the pin 65 stably inside the sector 63. The pin 77, which engages the cup body 83 through a hole 84 (FIG. 3), is maintained inside the respective seat 76 thanks to the particular shape of the front surface 85 (visible only in FIG. 3) which delimits the tab 78 on the side of the toothed sector 63. In particular said surface 85 is step-shaped. The portion of tab 78 having great thickness (visible in the excerpted view of FIG. 3) is dimensioned in such a way as to present a vertical extension that approximates the height of the teeth of the sector 63 itself, and the downward play allowed to pin 77 is greater than the thickness of the teeth of the sector 63. Thus, when the pin 77 is thrust downward against the resistance of the spring 82, the tab 78 frees the teeth of the sector 63. At this point the fork 64 is free from the tab 78, and it can be rotated around the axis 65*a*. Otherwise, when an upward thrust is kept on the pin 77 by the spring 82, a contact is established between the stepped portion of the surface 85 and the lower face of the toothed sector 63, so that the fork 64 is locked in a determined position, as are the annular bodies 69 and 70. In this situation, the angle between the axis 53 of the sleeve and of the axis 75 presents determined amplitude, depending on which compartment of the sector 63 is engaged by the tab 78.

The set of fork 64, pin 65, seat 76, pin 77, tab 78, and cup shaped body 83 defines a device 79 for adjusting the orientation of the angular position of the fork 64, and hence of the grip 71 with respect to the axis 53 and to the sleeve 61.

Naturally the description provided above also applies in case of electrical or fly wheel load units 30 (both known and thus not shown), as long as they can be activated by means of levers similar to the levers 50 provided with the handle 60, and if the grip is obtained from the same piece as the cylindrical end portion 67.

Figure 4:
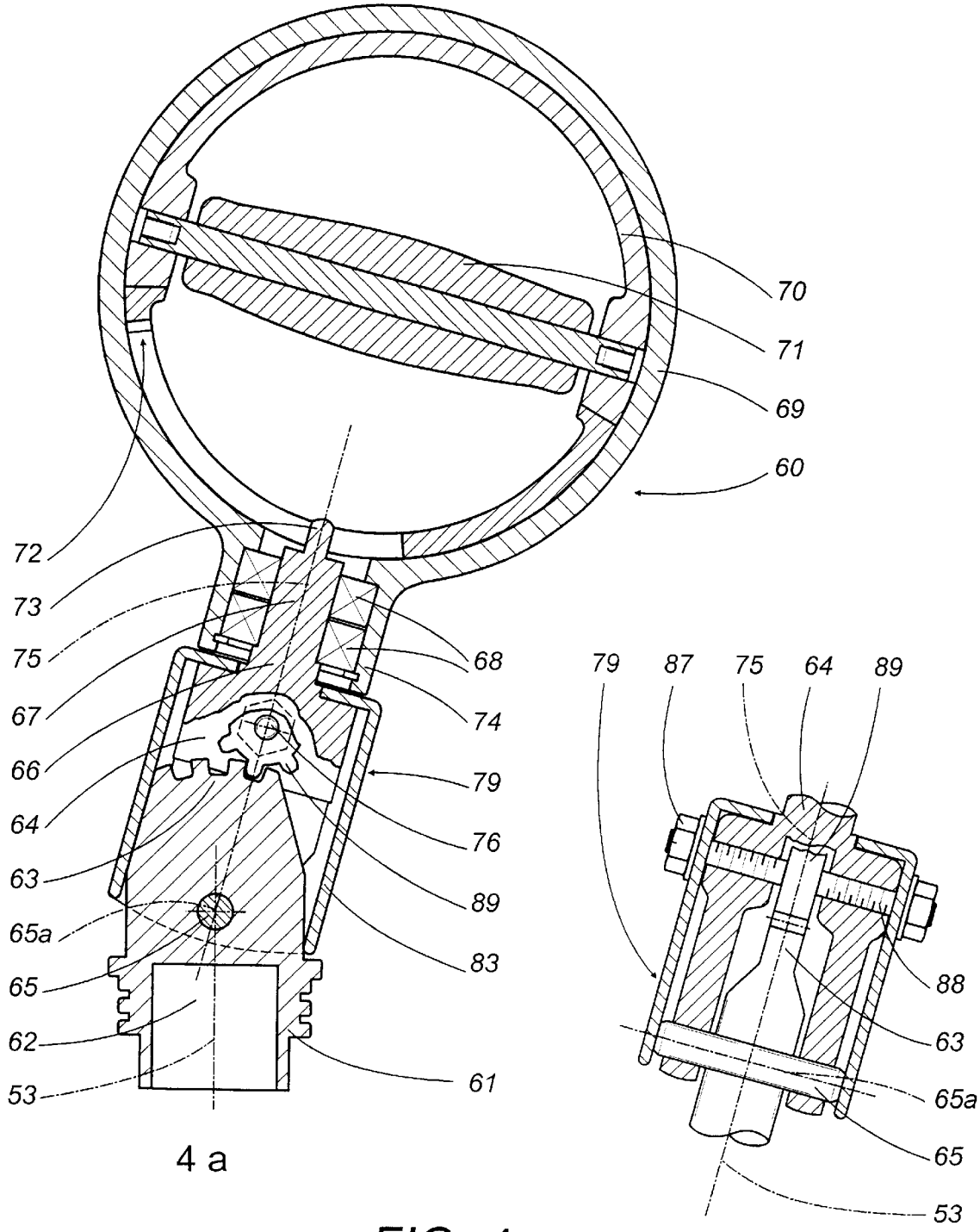
FIG. 4 is an enlarged scale section with parts removed for the sake of clarity of the first variation of the detail of FIG. 2, performed according to a longitudinal plane.

As described above the handle 60 allows the user to choose among a discrete number of positions, equal to the number of compartments of the toothed sector 63. In order to provide the user with the choice of a continuously variable angle, the device 79 can be modified by replacing the tab 78 with another toothed sector or, better yet, with a toothed wheel 89, whereof FIG. 4 shows only the portion enmeshing with the sector 63. The maintenance of a determined angular position by the grip 71 during the execution of an exercise is assured by a locking organ that makes the pin 77 integral to the fork 64, and hence prevents any undesired rotations of the wheel 89 itself. FIG. 4 shows a known threaded connection, which causes the rotation of the wheel 89 to stop as a result of friction between the nut 87 of the screw 88 and the cup shaped body 83. In this way the user can have an infinite number of positions available for the sleeve 71, thanks to the enmeshing between the sector 63 and the wheel 89, and can manage the trajectory of his/her wrist after adjusting the device 79.

In this case the adjusting device 79 comprises, instead of the tab 78, the wheel 89 and the nut 87. In any case, the sector 63 and the tab 78, or the sector 63 and the wheel 89 define a gear pair 86.

To improve the flexibility of use of the machine 1, FIG. 5 shows a further version of the handle 60, comprising an adjustment device 90 contained inside the lever 50, upstream of the portion 52. This device 90 allows to adjust at will the distance between the grip 71 and the axis 51, and therefore the physical lever arm between the grip 71 and the origin of the lever 50. In this way the lever 50 is easily employable by users presenting different anthropometric measurements. In particular, the device 90 comprises a slide-guide set 91 supported by the portion 52 serving as prismatic guide and support. Said set 91 comprises a slide defined by the tubular body 62 with greater length than that of FIGS. 3 and 4. The device 91 further comprises a pin 93 that is able to maintain constant the orientation of the tubular body 62 in the motion along the axis 53. The pin 93 engages the tubular body 62 in correspondence with a known longitudinal groove, not shown, which the tubular body 62 itself presents at its top, upstream of the sleeve 61.

The device 90 can be mechanical or electrical. In the first case (FIG. 5), the device 90 comprises the tubular body 62, duly elongated and worked so that it presents a plurality of through holes 62*a,* obtained transversely to the axis 53 and uniformly distributed. In parallel manner, the portion 52 presents a pair of diametral holes 55, transverse to the axis 53 and mutually coaxial. The handle 60 further comprises an instrument for measuring the distance of the grip 71 from the end portion 52 of the lever, which allows to compute the actual length of the physical lever arm, in order to be able consciously to reproduce a desired configuration for the machine 1. This instrument is defined by a graduated bar 3, borne at the top by the sleeve 61 on the side of the grip 71. Once the portion 61 is axially fastened to the portion 52 by means of a pin 56 engaging the holes 55 and one of the holes 62*a,* the part of bar that projects from the portion 52 is able to indicate the actual length of the lever arm.

With reference to FIG. 6, an electrical device 90 is described (FIG. 6), wherein the tubular body 62 is internally threaded, and is engaged by a threaded bar 94, coaxial to the axis 53, and able to be rotatorily actuated by means of an actuator organ. In particular, this actuator organ is an electrical motor 95 housed inside the lever 50, presenting a drive shaft 96 coaxial to the axis 53, and rigidly coupled to the bar 94. The rotation of the shaft 96 causes the actuation of the tubular body 62 and thus the variation in the position of the lever 60 along the axis 53. The distance of the grip 71 from the portion 52 is therefore adjustable and with it the extension of the lever arm.

Also with reference to FIG. 6, the handle 60 further presents a measuring device 97 able to determine the actual measurement of the lever arm, so as to allow a user to place, on each occasion, the grip 71 in a determined position, consciously reproducing a determined configuration. The device 97 comprises a proximity sensor installed in fixed position with respect to the lever 99, and a bearing surface 100 rigidly connected to the sleeve 61, for instance in a position alongside the pin 93. The device 97 further comprises an electronic processing unit 2, whereto the sensing organ 99 and the motor 95 are electrically connected. As is known, the sensor 99 is able to detect the position occupied by the bearing surface 100 and, in this specific case, the position of the bearing surface 100 itself along the axis 53. Therefore, by means of the processing unit 2 it is possible to compute the current position of the sleeve 61 itself, and of the grip 71. By means of the processing unit 2 (visible only in FIG. 1, which shows it externally to machine 1 purely for the sake of depiction convenience), it is also possible to command the activation of the motor 95, and change the positioning of the grip 71 with respect to the portion 52 also during the actuation of the levers 50.

Use of the machine 1 is easily understandable and requires no further explanation. In particular, machines for exercising the upper body muscles like machine 1, obtain definite advantages by the presence of handles like those described above. The set 4, comprising the devices 79 and 90, allows to adjust the trajectory of the grip 71 with respect to the zero of the lever 50 in correspondence with the fulcrum axis 51. The combination of the articulation and of the regulation of the length of the physical lever arm allows to personalize the trajectory of the grips 71 in such a way as to train a determined muscle district, common for all users of the machine 1, and like ones. Based on the description above, all versions of the handles 60 shown with reference to the accompanying drawing allow to adjust the trajectory of the grip 71 according to the anthropometric measurements of each user.

Lastly, it is clear that the machine 1 described and illustrated herein can be subject to modifications and variations without thereby departing from the protective scope of the present invention.

For instance, the replacement of an electrical set for the actuation of the wheel 89 and the device 79 does not modify the structure of the device 79 itself. Such modifications allows to automate the rotation of the fork 64, and to have it controlled by the processing unit 2, exactly as occurs with the electrical motor 95. In this way, the elimination of the nut 87 and of the corresponding screw 88 could be conceived, retaining the opportunity of controlling the current position of the fork 64 also during the actuation of the lever 50, and hence of the grip 71, based on determined requirements.

What is claimed is:

1. A machine for exercising muscles comprising:

a lever able to be actuated around a fulcrum axis to exercise upper body muscles;

said lever terminating with an end portion having a first longitudinal axis oriented in a determined direction;

a handle for actuating said lever supported by the end portion of the lever, said handle further including:

a first substantially cylindrical body which can be gripped by a user and a sleeve housed inside said end portion, said first body being hinged to said sleeve around a second axis substantially transverse to said first axis; and an adjustment set associated with said lever to vary the position of said first body with respect to an origin of said lever, to adapt the motion during use of said first body to the user's anthropometric measurements.

2. A machine according to claim 1, wherein said sleeve is substantially coaxial to said first axis, and said second axis intersects said sleeve;

said handle further comprising a second body hinged to said sleeve along said second axis;

said second body supporting said first body in a freely rotating manner;

a second adjustment set comprising first adjustment means able to orient said first body at an angle with respect to said first axis, and means second adjustment means able to adjust a distance between said first body and said end portion;

said second adjustment means comprising a slide-guide device supporting said sleeve to render said sleeve axially fixed and freely sliding along said lever.

3. A machine according to claim 2, wherein said first body is connected to said second body by a radial bearing, whereby the first body is free to rotate with respect to said sleeve in a direction perpendicular to said second axis.

4. A machine according to claim 2, wherein said second body is an end portion of said first body.

5. A machine according to claim 3 or 4, wherein said handle comprises a protective member having an annular shape and rotatably supporting said first body such that the first body may rotate around its own longitudinal axis substantially transverse to said first axis.

6. A machine according to claim 1, wherein said first adjustment means comprise a toothed portion of said first body; and a toothed portion of said second body, said toothed portions being disposed in facing relation such that teeth of the toothed portions may enmesh.

7. A machine according to claim 6, wherein said toothed portion of said second body is able to engage selectively at least a portion of said toothed portion of said first body.

8. A machine according to claim 7, wherein said first adjustment means comprise a seat within said second body and transverse to said first axis;

said seat being set in a position facing said toothed portion of said first body to house in an axially sliding and angularly fixed manner a pin supporting said toothed portion of said first body; and spring means cooperating with said pin to maintain said tooth portion of said second body in a determined axial position, and engaging said toothed sector transversely.

9. A machine according to claim 8, wherein said toothed portion of said second body is a tab.

10. A machine according to claim 9, wherein said tab is step-shaped.

11. A machine according to claim 8, wherein said toothed portion of said second body comprises a toothed wheel supported in a freely rotating and axially fixed manner by said second body in a position facing, and enmeshing with, said toothed portion of said first body;

means for locking the rotation of said wheel being provided to lock said second body in a determined position.

12. A machine according to claim 11, wherein said locking means are of the screw type.

13. A machine according to claim 2, wherein said adjustment group comprises second adjustment means enabling adjustment of a the distance between said first body with and said end portion; said second adjustment means comprising a slide-guide device supporting said sleeve to render said sleeve axially fixed and freely sliding along said lever.

14. A machine according to claim 13, wherein said second adjustment means comprise a measuring device able to identify a current longitudinal position of said sleeve, and a distance of said first body with respect to said lever.

15. A machine according to claim 14, wherein said measuring device comprises a graduated bar supported by said sleeve.

16. A machine according to claim 13, wherein said slide-guide device comprises at least a guide organ housed inside said lever on the side of the handle and internally delimited by a surface; said sleeve terminating on the side opposite to said first body with a slide organ internally threaded and coupled to said guide organ coupled to said surface.

17. A machine according to claim 15, wherein said second adjustment means comprise a rotatory actuation device, presenting a shaft coaxial to said first axis; a threaded bar, connected in an angularly rigid manner, coaxial to said shaft; said bar internally engaging said slide organ to actuate said sleeve along said first axis, allowing the adjustment of the distance of said first body with respect to said origin.

18. A machine according to claim 15, wherein said second adjustment means comprise a pin able to selectively engage transversely at least one of a plurality of holes transverse to said first axis and disposed in the body of said end portion of said lever to block said sleeve axially.

19. A machine according to any of the claim 15–18, wherein said actuation device is electrical; said measuring device comprises an electrical sensor organ; said actuation device and sensor organ being electrically connected; electronic computation means being connected to said actuating device and to said sensor device to command activation of said actuation device and variation of the positioning of said first body with respect to said end portion.

* * * * *